US005705097A

United States Patent [19]

Suzuki et al.

[11] Patent Number: 5,705,097

[45] Date of Patent: Jan. 6, 1998

[54] FLUORESCENT DISPLAY DEVICE WITH CONDUCTIVE PASTE HAVING AG, SB, AND ZN

[75] Inventors: Toshinori Suzuki; Kuniaki Kawatsu, both of Mobara, Japan

[73] Assignee: Futaba Denshi Kogyo Kabushiki Kaisha, Mobara, Japan

[21] Appl. No.: 505,783

[22] Filed: Jul. 21, 1995

Related U.S. Application Data

[63] Continuation of Ser. No. 272,000, Jul. 8, 1994, abandoned.

[30] Foreign Application Priority Data

Jul. 8, 1993 [JP] Japan ..... 5-169178

[51] Int. Cl.[6] ..... H01J 63/04; H01B 1/02; H01B 1/08

[52] U.S. Cl. ..... 252/514; 313/497; 252/518

[58] Field of Search ..... 252/500, 512, 252/514, 518; 313/483–522, 497

[56] References Cited

U.S. PATENT DOCUMENTS

| | | | |
|---|---|---|---|
| 4,084,114 | 4/1978 | Kuroda et al. | 313/496 |
| 4,256,513 | 3/1981 | Yoshida et al. | 252/514 X |
| 5,198,154 | 3/1993 | Yokoyama et al. | 252/514 |
| 5,344,592 | 9/1994 | Wilczek et al. | 252/514 X |
| 5,345,212 | 9/1994 | Brown | 252/514 X |
| 5,346,651 | 9/1994 | Oprosky et al. | 252/514 |
| 5,376,403 | 12/1994 | Capote et al. | 252/514 X |
| 5,378,408 | 1/1995 | Carroll et al. | 252/514 |
| 5,534,194 | 7/1996 | Borland et al. | 252/518 |
| 5,538,789 | 7/1996 | Capote et al. | 252/514 X |
| 5,594,296 | 1/1997 | Mitsutake et al. | 313/309 |
| 5,622,653 | 4/1997 | Orita et al. | 252/518 |

FOREIGN PATENT DOCUMENTS

| | | |
|---|---|---|
| 54-022596 | 2/1979 | Japan . |
| 54-022597 | 2/1979 | Japan . |

*Primary Examiner*—Douglas J. McGinty

*Attorney, Agent, or Firm*—Oblon, Spivak, McClelland, Maier & Neustadt, P.C.

[57] ABSTRACT

A conductive paste capable of effectively preventing current interruption in through-holes of a fluorescent display device. An anode substrate having Al film wirings formed thereon is laminatedly provided thereon with an insulating layer, which is then formed thereon with an anode conductor and phosphor layers in turn, leading to an anode. The insulating layer is formed with through-holes, in which the conductive paste is filled to make electrical connection between the wirings and the anode conductors. The conductive paste is formed of a mixture of Ag, glass and a vehicle, and Zn and/or Sb added to the mixture, wherein Zn and/or Sb are added to the mixture in an amount of 1 to 40 wt. % based on Ag. Zn and/or Sb serve as a catalyst for promoting alloying between Ag contained therein and Al, resulting in providing electrical connection therebetween with highly increased stability.

2 Claims, 2 Drawing Sheets

FLUORESCENT DISPLAY DEVICE WITH CONDUCTIVE PASTE HAVING AG, SB, AND ZN

This application is a continuation of application Ser. No. 08/272,000, filed on Jul. 8, 1994, now abandoned.

BACKGROUND OF THE INVENTION

This invention relates to a conductive paste made by mixing Ag, glass and a vehicle with each other, and more particularly to a conductive paste used, for example, for forming electrodes on an insulating substrate of a fluorescent display device.

In general, a fluorescent display device includes an envelope which is kept at a high vacuum. Such an envelope is constructed by sealedly assembling plate members each made of an insulating material such as, for example, glass into a box-like configuration.

Now, such a conventional envelope will be described hereinafter with reference to FIG. 2, which shows an essential part of a conventional fluorescent display device including such an envelope as described above.

The conventional fluorescent display device includes an anode substrate 1 constituting a part of the envelope. The anode substrate 1 is provided on an inner surface thereof with wirings 2 made of an aluminum film. The fluorescent display device also includes an insulating layer 3 arranged so as to cover the wirings 2 and anode substrate 1 and anode conductors 4 made of graphite or the like and formed on the insulating layer 3. The anode conductors 4 each have phosphor layers 5 deposited thereon, to thereby provide an anode 6 acting as a luminous display section. The insulating layer 3 is formed at predetermined portions thereof with through-holes 7, each of which is filled with a conductive paste 8 functioning to electrically connecting the wiring 2 and anode conductor 4 with each other therethrough.

The conductive paste 8 filled in each of the through-holes 7 is conventionally prepared by mixing a silver powder, a glass powder and a vehicle with each other. The silver powder and glass powder act as a conductive material and a binder, respectively, and the vehicle may comprise an organic solvent or viscous agent and acts to provide the silver and glass powders with paste-like properties.

The conventional fluorescent display device constructed as described above is manufactured by printing the insulating layer 3 formed with the through-holes 7 on the wirings 2 arranged on the anode substrate 1 to form an assembly and then subjecting the assembly to calcination at a temperature of 500° to 600° C. in an air atmosphere. Then, the through-holes 7 of the insulating layer 3 are charged with the conductive paste 8 and then the insulating layer 3 is further subject to calcination, so that the conductive paste 8 serves to electrically connect the wirings 2 to the anode conductor 4 formed on the insulating layer 3 in the subsequent step.

The above-described calcination of the insulating layer 3 causes portions of the Al wirings 2 exposed in the holes 7 to be oxidized, resulting in formation of an aluminum oxide ($Al_2O_3$) film. Unfortunately, the $Al_2O_3$ film exhibits insulating properties, leading to a failure in electrical connection between the conductive paste 8 filled in each of the through-holes 7 and the wiring 2 unless any suitable means is employed.

An approach to the problem has been conventionally adopted wherein a pulse of a high voltage is applied between cathodes of the fluorescent display device and the anodes for a short period of time in an aging step after assembling of the fluorescent display device, to thereby break down the $Al_2O_3$ film.

It would be considered that the $Al_2O_3$ film is varied in thickness and area depending on a portion thereof, however, it is impossible to recognize such a variation based on an appearance of the film. In view of the fact, breaking-down of the $Al_2O_3$ film by application of a high voltage thereto is conventionally carried out under conditions kept constant without considering the variation. Therefore, application of a voltage as low as about 12 V which corresponds to a driving voltage of a fluorescent display device often fails in electrical connection between the wiring and the conductive paste in the through-hole because of failing in positive braking-down of the $Al_2O_3$ film. Thus, the prior art fails to permit the conductive paste to constantly exhibit its satisfactory function in the through-hole due to a failure in braking-down of the oxide film.

SUMMARY OF THE INVENTION

The present invention has been made in view of the foregoing disadvantage of the prior art.

Accordingly, it is an object of the present invention to provide a conductive paste which is capable of positively accomplishing electrical connection with Al, to thereby effectively prevent current interruption, for example, in through-holes in a fluorescent display device.

It is another object of the present invention to provide a conductive paste which is capable of significantly simplifying manufacturing of a fluorescent display device.

It is a further object of the present invention to provide a conductive paste which is capable of eliminating non-uniformity of a luminous display of a fluorescent display device due to charging of electrons thereon.

In accordance with the present invention, a conductive paste is provided. The conductive paste comprises a mixture of Ag, glass and a vehicle, and a material selected from the group consisting of Zn and Sb and added to the mixture. The material is added to the mixture in an amount of 1 to 40 wt. % based on Ag.

Also, in accordance with the present invention, a conductive paste is provided. The conductive paste comprises a mixture of Ag, glass and a vehicle, and Zn and Sb added to the mixture. The Zn and Sb are added to the mixture in a total amount of 1 to 40 wt. % based on Ag.

In a preferred embodiment of the present invention, the Zn and Sb are mixed with each other at a ratio of 1:1.

In the present invention constructed as described above, Zn and/or Sb contained in the conductive paste act as a catalyst for promoting alloying between Al and Ag during a heating step in manufacturing of a fluorescent display device.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 2:
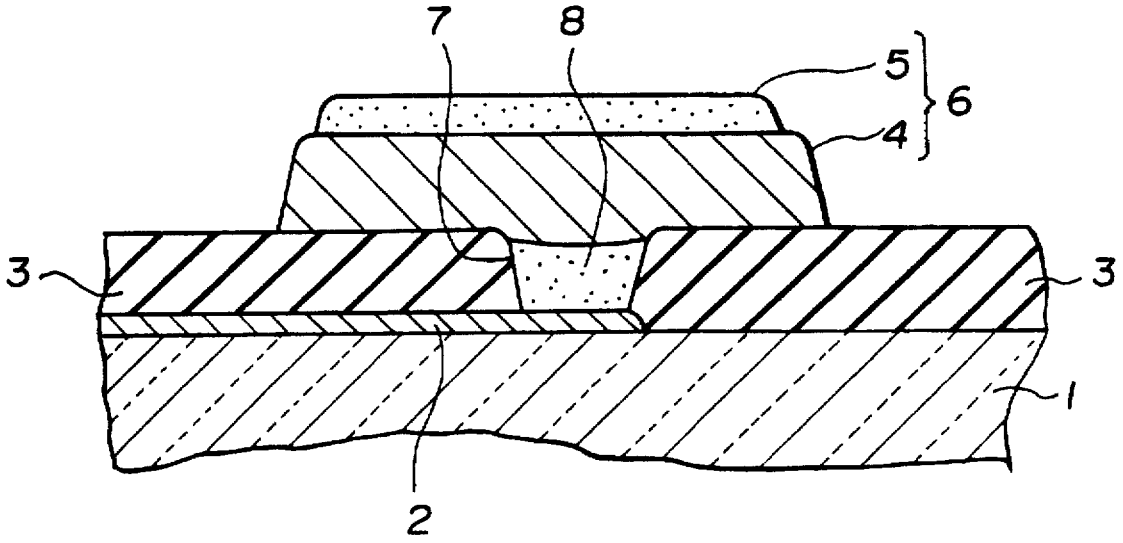
FIG. 2 is a fragmentary enlarged sectional view showing an essential part of a fluorescent display device around an anode substrate in which a conventional conductive paste is filled in each of through-holes of an insulating layer.

Now, a conductive paste according to the present invention will be described hereinafter with reference to the accompanying drawings. A fluorescent display device to which a conductive paste of the illustrated embodiment is applied may be constructed in substantially the same manner as the conventional one as shown in FIG. 2.

The inventor, as a result of studying the above-described problem encountered with the prior art, came to a novel conception that alloying between Al used for wirings of a fluorescent display device and Ag contained in the conductive paste would permit the above-described current interruption or failure in electrical connection in the through-hole encountered with the prior art to be effectively eliminated. Then, the inventor experimentally studied various metal materials aiding in the alloying for the purpose of finding find a catalyst suitable for promoting the allying. As a result, it was found that Zn and/or Sb are most suitable for use as a catalyst for promoting alloying between Al and Ag.

Also, the inventor made an experiment for determining an amount of Zn and Sb added as the catalyst. As a result, it was found that when only one of Zn and Sb is used as the catalyst, addition of it in an amount of 1 to 40 wt. % based on Ag permits it to exhibit a satisfactory function as the catalyst. The amount of Zn or Sb below 1 wt. % is not preferable because of causing the function to be reduced, whereas that exceeding 40 wt. % causes electrical conductivity of the paste to be deteriorated because it leads to a disadvantage decrease in amount of Ag.

Thus, it will be noted that the conductive paste of the present invention is featured in that it comprises a mixture of Ag, glass and a vehicle, and a material selected from the group consisting of Zn and Sb and added to the mixture, wherein the material is added to the mixture in an amount of 1 to 40 wt. % based on Ag. An experiment made by the inventor revealed that a fluorescent display device constructed using the conductive paste of such a composition is free of such a failure in electrical connection or current interruption in the through-holes as described above.

Table 1 shows a composition of a conductive paste prepared in each of Examples 1 to 5.

| | Composition (wt %) | | | | |
|---|---|---|---|---|---|
| Example | Ag | Zn | Sb | Glass | Vehicle |
| 1 | 54 | 10 | — | 13 | 23 |
| 2 | 56 | — | 6 | 15 | 23 |
| 3 | 56 | 3 | 3 | 15 | 23 |
| 4 | 57 | 1 | 4 | 15 | 23 |
| 5 | 50 | — | 20 | 10 | 20 |

Figure 1:
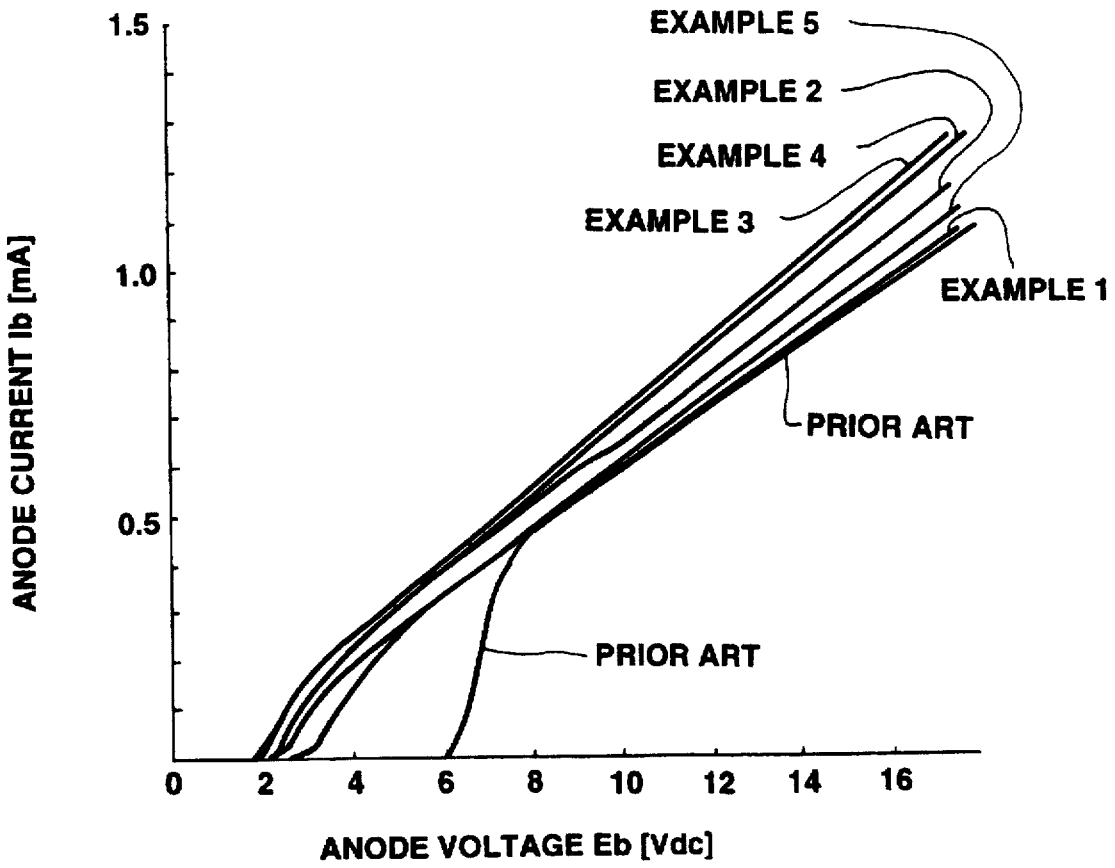
FIG. 1 is a graphical representation showing a relationship between an anode current and an anode voltage in a fluorescent display device wherein an embodiment of a conductive paste according to the present invention is used for electrical connection in each of through-holes of an insulating layer.

FIG. 1 shows a relationship between an anode current and an anode voltage in a fluorescent display device in which the conductive paste of each of Examples 1 to 5 is used for electrical connection in each of through-holes of an insulating layer of a fluorescent display device constructed in such a manner as shown in FIG. 2. FIG. 1 also shows, for the sake of comparison, data on a fluorescent display device in which the conventional conductive paste described above is used.

As indicated in FIG. 1, the fluorescent display device having the conventional conductive paste used therein exhibits a luminescence initiating voltage as high as about 6 V even when any current interruption or failure in electrical connection in the through-holes does not occur. When the failure occurs, the voltage is increased to a high level of about 12 V. On the contrary, the fluorescent display device in which the conductive paste of each of Examples 1 to 5 is used is free of any failure in electrical connection and permits flowing of an anode current to be initiated at a voltage as low as above 2 V, leading to initiation of luminescence at such a low voltage.

The reason would be that Zn and/or Sb exhibit a catalytic action which permits alloying between a portion of an Al wiring on an anode substrate positioned within each of through-holes of the anode substrate and the conductive paste in the though-hole to be accomplished, resulting in electrical resistance in the through-hole being significantly reduced. In each of Examples 1 to 5, $Ag_2Al$ which is alloy formed between Al and Ag was observed at a boundary or interface between the Al wiring and the conductive paste.

In particular, it was found that incorporation of both Zn and Sb in the conductive paste permits stability of electrical conductivity at an interface between the Al wiring and the conductive paste in the through-hole to be further increased, as noted form Examples 3 and 4. More particularly, as shown in FIG. 1, Examples 3 and 4 each permit an anode current under the same voltage to be increased as compared with the remaining examples.

In particular, as noted from example 3, setting of a mixing ratio between Zn and Sb at 1:1 permits stability of electrical conductivity at the interface to be still further increased, so that Example 3 exhibits the best results in all the examples.

In the illustrated embodiment, the conductive paste is provided in each of the through-holes of the anode substrate of the fluorescent display device, however, the conductive paste of the present invention is not limited to such application. For example, it may be effectively used for connection between an Al wiring and another conductor in another display element of electronic element.

As can be seen from the foregoing, the conductive paste of the present invention comprises the mixture of Ag, glass and the vehicle, and Zn and/or Sb added to the mixture, wherein Zn and/or Sb are added to the mixture in an amount of 1 to 40 wt. % based on Ag in combination or solely. The conductive paste thus constructed, when it is used for electrical connection with a connection element made of Al, permits Zn and/or Sb contained therein to function as a catalyst for promoting alloying between Ag contained therein and the Al, resulting in providing the electrical connection with highly increased stability.

In particular, when the conductive paste of the present invention exhibits various advantages when it is used for electrical connection between the anode conductor and the Al wiring in each of the through-holes of the insulating layer of the fluorescent display device.

More particularly, filling of the conventional conductive paste in each of the through-holes for electrical connection between the anode wiring and the anode conductor fails in flowing of an anode current, leading to a failure in luminescence of the fluorescent display device, unless an anode voltage is increased to a level of about 6 V or more. On the contrary, the conductive paste of the present invention significantly reduces a luminescence initiating voltage. More specifically, the conductive paste of the present invention permits an anode current to start to flow at an anode voltage as low as about 2 V, leading to initiation of luminescence at such a low voltage. Thus, it effectively prevents current interruption in the through-hole at the time when the fluorescent display device is turned on.

Also, the conventional conductive paste requires to apply a high voltage between the cathode and the anode to carry out dielectric breakdown, to thereby eliminate current interruption. Unfortunately, this causes electrons to be charged in the fluorescent display device, leading to non-uniformity in luminous display. On the contrary, the conductive paste of the present invention eliminates a necessity of dielectric breakdown by application of a high voltage, to thereby simplify manufacturing of the fluorescent display device and prevent non-uniformity in display due to charging of electrons.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device, comprising:

a substrate;

a wiring pattern made of aluminum, said wiring pattern being deposited on a surface of said substrate;

an insulating layer arranged on a surface of said wiring pattern and said substrate, said insulating layer having through-holes at predetermined portions thereof to expose said wiring pattern;

anode conductors formed on said insulating layer having phosphor layers deposited thereon and covering said through-holes and a conductive paste filled in said through-holes for electrically connecting said wiring pattern to said anode conductors;

wherein said conductive paste contains Ag, glass, a vehicle, Zn and Sb, wherein the total amount of Zn and Sb is within the range of 1 to 40% by weight of Ag.

2. The fluorescent display device of claim 1, wherein said Zn and Sb are mixed at a ratio of 1:1.

* * * * *